United States Patent [19]

Collins

[11] 4,079,078

[45] Mar. 14, 1978

[54] LIQUID DETERGENT COMPOSITIONS

[75] Inventor: Jerome H. Collins, Cincinnati, Ohio

[73] Assignee: The Procter & Gamble Company, Cincinnati, Ohio

[21] Appl. No.: 521,413

[22] Filed: Nov. 6, 1974

Related U.S. Application Data

[63] Continuation-in-part of Ser. No. 481,726, Jun. 21, 1974, abandoned.

[51] Int. Cl.[2] ..... C11D 3/24; C11D 3/34; C11D 7/34

[52] U.S. Cl. ..... 252/545; 252/118; 252/143; 252/153; 252/156; 252/546; 252/548; 252/559; 252/DIG. 1; 252/DIG. 14

[58] Field of Search ..... 252/545, 546, 559, 548, 252/DIG. 1, DIG. 14, 153, 143, 118, 156

[56] References Cited

U.S. PATENT DOCUMENTS

| | | | |
|---|---|---|---|
| 3,042,621 | 7/1962 | Kirschenbauer | 252/99 |
| 3,382,178 | 5/1968 | Lissant et al. | 252/135 |
| 3,440,171 | 4/1969 | Warren | 252/152 |
| 3,663,445 | 5/1972 | Augustin et al. | 252/117 |
| 3,679,609 | 7/1972 | Castner | 252/527 |
| 3,812,041 | 5/1974 | Inamorato | 252/89 |

FOREIGN PATENT DOCUMENTS

| | | |
|---|---|---|
| 794,713 | 7/1973 | Belgium. |

*Primary Examiner*—Mayer Weinblatt

*Attorney, Agent, or Firm*—Robert B. Aylor; Thomas H. O'Flaherty; Richard C. Witte

[57] ABSTRACT

Heavy duty liquid detergent compositions containing a mixture of particular nonionic surfactants, anionic surfactants, alkanolamines, and minor amounts of fatty acid-based corrosion inhibitors, said compositions being especially adapted for stain and soil removal from fabrics either when applied directly to such fabrics before washing or when employed as detergent compositions for conventional fabric laundering, are provided. In a preferred embodiment an alkali metal base in an amount sufficient to raise the pH of the composition to 7.5 to 10 is added for increased corrosion inhibition.

12 Claims, No Drawings

LIQUID DETERGENT COMPOSITIONS

This application is a continuation-in-part of Ser. No. 481,726 filed June 21, 1974, now abandoned.

BACKGROUND OF THE INVENTION

The present invention relates to concentrated heavy duty liquid detergent compositions. Such compositions contain, as the active detersive ingredients, a nonionic surfactant component, an anionic surfactant component, and an alkanolamine component. The compositions also contain a minor proportion of a fatty acid corrosion inhibitor, and, in a preferred embodiment, an alkali metal base.

Heavy duty liquid detergent compositions are well known in the art. Usually such compositions (see, for example, U.S. Pat. Nos. 2,908,651; 2,920,045; 3,272,753; 3,393,154; and Belgian Pats. 613,165 and 665,532) contain a synthetic organic detergent component which is generally anionic, nonionic, or mixed anionic-nonionic in nature; an inorganic builder salt; and a solvent, usually water and/or alcohol. These compositions frequently contain a hydrotrope or solubilizing agent to permit the addition of sufficient quantities of surfactant and builder salt to provide a reasonable volume usage/performance ratio. While such liquid detergent compositions have been found effective for some types of home laundering, the presence of inorganic builder salts in such compositions may be undesirable from an ecological standpoint in improperly treated sewage.

Several attempts have been made to formulate builder-free, hydrotrope-free liquid detergent compositions. For example, U.S. Pat. No. 3,528,925 discloses substantially anhydrous liquid detergent compositions which consist of an alkyl aryl sulfonic acid, a nonionic surface active agent and an alkanolamine component. U.S. Pat. No. 2,875,153 discloses liquid detergent compositions containing a nonionic surfactant component and a sodium soap component. U.S. Pat. No. 2,543,744 discloses a low-foaming dishwashing composition comprising a nonionic, water-soluble, synthetic detergent and a water-soluble soap in the form of an alkali metal, ammonium or amine salt. All of these detergent compositions are effective for certain types of washing operations, but none of the commercially available compositions of this kind are highly effective both as pre-treatment and heavy duty washing agents for cleaning both natural and synthetic fabrics.

U.S. Pat. No. 3,663,455 relates to liquid cleaning and defatting compositions containing a nonionic surfactant, an alkanolamine-neutralized anionic surfactant, alkanolamine, and fatty acid.

The co-pending application of Collins, Ser. No. 222,363, filed Jan. 31, 1972, entitled LIQUID DETERGENT COMPOSITIONS, relates to detergent mixtures comprising a high ratio of nonionic to anionic surfactant and free alkanolamine.

U.S. Pat. Nos. 3,709,838; 3,697,451; 3,554,916; 3,239,468; 2,947,702; 2,551,634; British Pat. Nos. 900,000; 842,813; 759,877; Canadian Pat. No. 615,583; and Defensive Publications T903,009 and T903,010 disclose a variety of detergent compositions containing mixed nonionic-anionic surfactants, both with and without alkanolamines.

As can be seen from the foregoing, a substantial effort has been expended in developing low-built and builder-free detergent compositions in liquid form. Yet, there are several problems associated with the art-disclosed compositions which render them less than optimal for wide-scale use.

First, many of the prior art compositions contain phosphorus-based builder materials. Such builders, and compositions containing same, may not be useful in areas of the country having improperly treated sewerage effluents.

Second, many of the prior art compositions are formulated at too low a ratio of nonionic:anionic surfactant to provide optimal oily soil removal from fabrics.

Third, many of the prior art compositions are formulated to provide satisfactory through-the-wash fabric cleaning performance, but do not provide optimal prewash treatment of oily soil found in collars and cuffs of fabrics. Most users of liquid laundry detergent compositions expect that superior fabric cleansing can be secured by applying the liquid product directly, at full strength, to heavily soiled areas of the fabric prior to laundering. Accordingly, it is desirable to provide a liquid detergent having optimal pre-treatment cleaning benefits as well as optimal through-the-wash cleaning performance.

Finally, the prior art (see U.S. Pat. No. 3,663,445) discloses that surfactant compositions containing high concentrations of ethylene oxide-based nonionic surfactants and alkanolamines must contain at least about 3% by weight of fatty acid salts to provide the desired product stability and/or performance characteristics. Due to supply problems with fatty acids, it is highly desirable to provide stable, high cleaning, mixed nonionic/anionic detergent compositions having a high concentration of ethylene oxide-based nonionic surfactants without the need for such large amounts of additives derived from fatty acids.

The co-pending application of Collins, et al., entitled LIQUID DETERGENT COMPOSITIONS, Ser. No. 376,641, filed July 5, 1973, the disclosures of which are incorporated herein by reference, teaches that certain ethylene oxide-based nonionic surfactants can be used at high concentrations in liquid detergent compositions, in combination with alkanolamines and certain anionic surfactants, and without the need for fatty acid-based stabilizers. The compositions disclosed by Collins, et al., provide builder-free, liquid detergent compositions which exhibit both excellent pre-wash and through-the-wash fabric cleansing. It would be desirable to include a corrosion inhibitor in such compositions. Unfortunately, many such inhibitors are phosphorus-based and are obviously not the compounds of choice when formulating phosphorus-free compositions. Moreover, any corrosion inhibitor must be compatible with the essential cleaning agents in the formulation, as well as being safe for use on fabrics.

It has now been discovered that fatty acids especially oleic acid, used in minor proportions in the present compositions provide good corrosion protection in automatic washers. Inclusion of a sufficient amount of an alkali metal base also in the present compositions provides even better corrosion protection.

It is an object of this invention to provide stable liquid detergent compositions which exhibit excellent prewash and through-the-wash fabric cleaning, yet which protect metal surfaces from corrosion.

It is another object herein to provide stable liquid detergent compositions containing high concentrations of nonionic surfactants and free alkanolamines, anionic surfactants, and minor amounts of fatty acid corrosion inhibitors, said compositions being formulated to exhibit optimal cleaning and sudsing characteristics.

These and other objects are obtained herein, as will be seen from the following disclosure.

SUMMARY OF THE INVENTION

The present invention encompasses liquid detergent compositions comprising: (a) from about 20% to about 50% by weight of a nonionic surfactant produced by the condensation of from about 5 moles to about 11 moles of ethylene oxide with one mole of a $C_{13}$ to $C_{16}$ alcohol, said nonionic surfactant being further characterized by a hydrophilic-lipophilic balance of from about 9.5 to 15, preferably 11 to 13, or mixtures thereof; (b) an anionic surfactant of the type hereinafter disclosed in an amount sufficient to provide a weight ratio of nonionic surfactant to anionic surfactant within the range of from about 1.8:1 to about 3.5:1 based on the free acid form of the anionic surfactant; (c) an alkanolamine in an amount sufficient to provide at least 1% by weight of the composition of free alkanolamine; and (d) from about 0.15% to about 2% by weight of a $C_{10}$–$C_{22}$ fatty acid corrosion inhibitor.

From about 0.1% to 4% of an alkali metal base is added to the liquid detergent composition described above in a preferred embodiment to obtain an increased corrosion inhibition effect.

Highly preferred nonionic surfactants for use herein are alcohol ethylene oxide condensates wherein the alcohol contains from 14 to 15 carbon atoms and wherein the condensate contains from 6 to 9 moles of ethylene oxide (hydrophilic) per mole of alcohol (lipophilic). Such materials are commonly abbreviated as $C_{14\text{-}15}EO_{6\text{-}9}$.

DETAILED DESCRIPTION OF THE INVENTION

The individual components of the instant detergent compositions are described in detail below.

The Nonionic Surfactant

The instant compositions contain as an essential ingredient about 20% to about 50%, preferably from about 25% to about 40%, most preferably from about 31% to about 34%, by weight of a nonionic surfactant derived by the condensation of ethylene oxide with an alcohol having a carbon content of from $C_{13}$ to about $C_{16}$. As more fully described in the co-pending application of Collins, et al., ethylene oxide condensates having more than about 16 carbon atoms in the alkyl chain of the alcohol portion of the molecule are not particularly useful for either through-the-wash or pre-treatment fabric cleansing.

The nonionic surfactants employed herein contain from about 5 (avg.) moles of ethylene oxide to about 11 (avg.) moles of ethylene oxide per mole of alcohol in the condensate. However, it is not sufficient simply to describe the nonionic surfactants used herein merely in terms of their alkyl carbon content and ethylene oxide content, inasmuch as certain of the nonionic surfactants falling within this broad definition lie outside the range of nonionics used herein. Accordingly, the nonionic surfactants herein must also be defined in terms of their hydrophilic-lipophilic balance.

The individual nonionic surfactants employed in the compositions herein are commonly thought of as constituting a hydrocarbyl chain (derived from the alcohol) condensed with an ethylene oxide chain. The hydrocarbyl portion of such materials gives rise to their lipophilic characteristics, whereas the ethylene oxide portion determines their hydrophilic characteristics. The overall hydrophilic-lipophilic characteristics of a given hydrocarbyl-ethylene oxide condensate are reflected in the balance of these two factors, i.e., the hydrophilic-lipophilic balance (HLB). The HLB of the ethoxylated nonionics herein can be experimentally determined in well-known fashion, or can be calculated in the manner set forth in Decker, "Emulsions Theory and Practice" Reinhold 1965, pp. 233 and 248.

For example, the HLB of the nonionic surfactants herein can be approximated by the simple expression $$HLB = E/5$$

wherein E is the weight percentage of ethylene oxide content in the molecule. Of course, the HLB will vary, for a given hydrocarbyl content, with the amount of ethylene oxide.

Accordingly, the nonionic materials herein falling within the preferred range are fully described as alcohols having a carbon content of from $C_{13}$ to about $C_{16}$ condensed with from about 5 (avg.) moles to about 11 (avg.) moles of ethylene oxide per mole of alcohol, and further characterized by an HLB within the range of from about 9.5 to about 15, preferably from about 11 to about 13. Nonionic surfactants falling within these ranges are highly preferred herein from the standpoint of optimal pre-treatment cleansing, optimal through-the-wash cleansing and product stability.

The nonionic surfactants employed in the present compositions can be prepared by a variety of methods well known in the art. In general terms, such nonionic surfactants are prepared by condensing ethylene oxide with an alcohol under conditions of acidic or basic catalysis.

The nonionic surfactants herein include the ethylene oxide condensates of both primary and secondary alcohols; the condensates of primary alcohols are preferred. Non-limiting, specific examples of nonionic surfactants having the requisite carbon content of the hydrocarbyl portion of the molecule, the requisite ethylene oxide content and the requisite HLB are as follows: n-$C_{13}H_{29}(EO)_5$; n-$C_{14}H_{29}(EO)_6$; N-$C_{14}H_{29}(EO)_7$; n-$C_{14}H_{29}(EO)_{10}$; n-$C_{15}H_{31}(EO)_6$; n-$C_{15}H_{31}(EO)_7$; 2-$C_{15}H_{31}(EO)_7$; n-$C_{15}H_{31}(EO)_8$; 2-$C_{15}H_{31}(EO)_8$; n-$C_{15}H_{31}(EO)_9$; 2-$C_{15}H_{31}(EO)_9$; n-$C_{16}H_{33}(EO)_9$; and 2-$C_{16}H_{33}(EO)_9$.

It is to be recognized that mixtures of the foregoing nonionic surfactants are also useful herein and are readily available from commercial alcohol mixtures. Moreover, the degree of ethoxylation can vary somewhat, inasmuch as average fractional degrees of ethoxylation occur. For example, n-$C_{15}H_{31}(EO)_7$ can contain small quantities of n-$C_{15}H_{31}(EO)_0$ and n-$C_{15}H_{31}(EO)_{14}$. Such commercial mixtures falling within the limits disclosed herein are useful in the present detergent compositions.

The preferred nonionic surfactants are the $C_{14\text{-}15}(EO)_{6\text{-}9}$, especially n-$C_{14\text{-}15}(EO)_7$, materials disclosed hereinabove and are commercially available as mixtures under the names Neodol 45-7 and Neodol 45-9 from the Shell Chemical Co. Neodol 45-7 is a liquid at ambient temperatures and is preferred herein. Neodol 45-9 is a solid at room temperature, but is useful in the liquid detergent compositions of this invention inasmuch as it readily dissolves therein.

The presence of the nonionic surfactant in the instant liquid detergent compositions in the essential specified concentrations and proportions provides oily stain removal in both pre-treatment application and through-the-wash utilization of the compositions.

The Anionic Surfactant

The anionic component of the present detergent compositions is an alkanolamine salt of an alkylbenzene sulfonic acid (an alkanolamine alkylbenzene sulfonate). The alkanolamime alkylbenzene sulfonate salts are prepared by neutralizing an alkylbenzene sulfonic acid with an alkanolamine selected from the group consisting of monoethanolamine, diethanolamine and triethanolamine. The triethanolamine salts are preferred herein. The anionic surfactant salt is employed herein in a quantity sufficient to provide a weight ratio of nonionic surfactant to anionic surfactant of from about 1.8:1 to about 3.5:1, more preferably a ratio of about 1.9:1 to about 3.0:1, based on the free acid form of the anionic surfactant. The most highly preferred nonionic:anionic (free acid form) weight ratio is about 1.9:1 to about 2.2:1.

More specifically, the anionic surfactant herein consists of a mono-, di- or triethanolamine salt of a straight or branched chain alkylbenzene sulfonic acid in which the alkyl group contains from about 9 to about 15 carbon atoms. Preferred surfactants of this type are those in which the alkyl chain is linear and averages about 11.4 to 12 carbon atoms in length. Examples of alkanolamine alkylbenzene sulfonates useful in the instant invention include monoethanolamine decyl benzene sulfonate, diethanolamine undecyl benzene sulfonate, triethanolamine dodecyl benzene sulfonate, monoethanolamine tridecyl benzene sulfonate, triethanolamine tetradecyl benzene sulfonate, and diethanolamine tetrapropylene benzene sulfonate, and mixtures thereof. The most highly preferred anionic surfactant is $C_{11.4}$ (avg.) alkyl benzene sulfonate neutralized with triethanolamine, which preferably comprises from 15% to 17.5%, especially, 15.8% to 17.0%, by weight of the liquid compositions herein, based on the free acid form.

Examples of commercially available alkylbenzene sulfonic acids useful in preparing the alkanolamine sulfonates of the instant invention include Conoco SA 515, SA 597, and SA 697, all marketed by the Continental Oil Company, and Calsoft LAS 99, marketed by the Pilot Chemical Company.

The Alkanolamine

A third essential component of the detergent compositions of the present invention is the alkanolamine compound. The alkanolamine useful herein is selected from the group consisting of monoethanolamine, diethanolamine, triethanolamine, and mixtures thereof. Mixtures of these three alkanolamine compounds are produced by the reaction of ethylene oxide with ammonia. The pure compounds can be separated from such mixtures by standard distillation procedures.

The alkanolamine component used in the compositions herein serves two purposes. As will be discussed more fully hereinafter, in the preferred method for preparing the compositions the alkanolamine neutralizes the free acid form of the anionic surfactant to provide the corresponding alkanolamine salt which is an essential component of the instant detergent compositions. In addition, the excess alkanolamine beyond that necessary to form the anionic surfactant salt contributes to detergency performance and serves as a buffering agent which maintains wash water pH of the present compositions within the preferred range from about 7 to about 9. A pH of about 7.8 is most preferred. It is essential that the compositions of this invention contain at least 1% by weight of the total composition of free alkanolamine, i.e., an excess over that needed to neutralize the alkylbenzene sulfonic acid anionic surfactant and other acidic components.

Stable liquid detergent compositions containing nonionic, anionic and alkanolamine components can be formulated by preparing each component separately and thoroughly mixing them together in any order. In a preferred method for preparing the instant compositions, the anionic and alkanolamine components are formulated simultaneously by over-neutralizing the alkylbenzene sulfonic acid with alkanolamine. This method forms the requisite alkanolamine alkylbenzene sulfonate and provides the free alkanolamine component of the instant composition. Preferably, the compositions contain from about 2.0% to about 10.0% by weight of free alkanolamine, most preferably triethanolamine. The total triethanolamine used in the compositions is preferably about 11% by weight. This is more than sufficient to neutralize the acidic components and to provide the requisite free alkanolamine.

The Fatty Acid Corrosion Inhibitor

The present compositions also contain, as an essential ingredient, from about 0.15% to about 2.0%, preferably from 0.3% to 1.2%, more preferably from 0.5 to 1.0%, by weight (based on the free acid form) of a $C_{10}$–$C_{22}$ fatty acid. It will be recognized that this fatty acid component will be present in the instant compositions primarily in the form of the alkanolamine salt, due to the large excess of the free alkanolamine. The fatty acid can be added to the mixture in the same manner as the alkylbenzene sulfonic acid disclosed hereinabove, said mixture thereafter being over-neutralized with excess alkanolamine.

While not intending to be limited by theory, it appears that the fatty acids employed herein, either the form of the free acids or their alkanolamine salts, are attracted to iron and/or steel surfaces wherein they provide some type of coating function or otherwise provide a useful degree of passivity to the surface. The resulting passive metal surfaces are not thereafter readily oxidized or otherwise corroded. Surprisingly, the fatty acid materials are attracted to the surfaces to provide their corrosion inhibiting benefits even in the presence of high concentrations of nonionic surfactants and alkylbenzene sulfonates of the type disclosed hereinabove which, themselves, are extremely effective in removing greasy and fatty-based materials from surfaces.

Both saturated and unsaturated fatty acids, and commercial mixtures thereof such as the coconutalkyl fatty acids and tallowalkyl fatty acids, are useful corrosion inhibitors in the present compositions. Specific examples of such compounds include n-decanoic acid, n-dodecanoic acid, n-tetradecanoic acid, n-pentadecanoic acid, n-hexadecanoic acid, n-octadecanoic acid, n-eicosanoic acid, and n-docosanoic acid. Unsaturated fatty acids useful herein include, for example, oleic acid, linoleic acid, eleostearic acid, ricinoleic acid, vaccenic acid, erucic acid, tariric acid, and the like. Primary, secondary and tertiary fatty acids are useful herein. The most highly preferred carboxylic acid for use herein as a corrosion inhibitor is oleic acid.

ALKALI METAL BASES

In a preferred embodiment of this invention, an alkali metal base is added to the above-described detergent composition to provide additional corrosion inhibition protection. An alkali metal base such as sodium or potassium hydroxide, preferably potassium hydroxide, is added at a level of from about 0.1% to about 4% by weight of the total composition. Preferably from about 1.0% to about 2.5% by weight of the total composition of the alkali metal hydroxide is used.

The addition of the alkali metal base imparts a pH of from 7.5 to 10, preferably 8 to 9, to the compositions. It has been discovered that this alkaline pH gives added corrosion inhibition action to the compositions of this invention. A pH above 10 is avoided because of product instability. Another benefit derived from the inclusion of the alkali metal base in the detergent composition is the de-gellant effect it provides.

It will be recognized that in this preferred embodiment, some or all of the alkali metal ions from the base can be exchanged with the cationic alkanolamine of the alkylbenzene sulfonic acid and fatty acid salts. Accordingly, the anionic surfactant is an alkanolamine or alkali metal salt or mixtures thereof of an alkyl benzene sulfonic acid. The alkyl chain length of the alkylbenzene sulfonic acid and the ratio of the nonionic surfactant to the sulfonic acid (expressed as free acid) as discussed above, of course, are the same.

Optional Components

Although the liquid detergent compositions of the instant invention need only contain the abovedescribed components (i.e., thick, anhydrous compositions), highly preferred compositions herein contain, in addition to the detersive ingredients and corrosion inhibitor, a solvent selected from the group consisting of water and water-alcohol mixtures. Such solvents can be employed to the extent of from about 1% to 45% by weight of the total detergent composition. In preferred compositions the solvent comprises from about 25% to 45%, most preferably about 33% to about 40%, by weight of the total composition. Use of such solvents in the compositions herein has several advantages. First, the physical stability of the detergent compositions can be improved by dilution with such solvents in that clear points can thereby be lowered. The diluted compositions do not cloud at the low temperatures which are commonly encountered during shipping or storing of commercially marketed detergent compositions.

Secondly, addition of solvents, especially wateralcohol mixtures, serves to regulate the gelling tendency which liquid detergent compositions of the instant type exhibit upon dilution with water.

When an alcohol-water mixture is employed as the carrier solvent herein, the weight ratio of water to alcohol preferably is maintained above about 5:1. High alcohol (particularly ethanol) concentrations in the water-alcohol mixtures used in the instant compositions are preferably avoided because of flammability problems which may arise at such higher alcohol levels. Moreover, those compositions which do not contain an alkali metal base contain a de-gellant such as potassium chloride, which may give rise to alkanolamine hydrochlorides after prolonged storage and chilling. To prevent the crystallization of such materials in the liquid compositions, it is most preferred to use carrier liquids comprising water and alcohol at a higher water:alcohol weight ratio, i.e., ratios of at least about 5:1, preferably about 5:1 to about 20:1.

Any alcohol containing from 1 to about 5 carbon atoms can be employed in the water-alcohol diluent used to prepare liquid detergent compositions. Examples of operable alcohols include methanol, ethanol, propanol, isopropanol, butanol, isobutanol, and pentanol; ethanol is highly preferred for use herein. Preferred compositions herein contain from about 25% to about 40%, most preferably 30% to 36%, by weight of water and 2.0% to 5.5%, most preferably 4.0% to 5.0% by weight of ethanol.

Another optional component which can be added to the detergent compositions of the instant invention is an electrolyte salt. As pointed out in U.S. Pat. Nos. 2,580,173 and 3,440,171, electrolyte salts lessen the gel formation which tends to occur with alkanolamine-neutralized surfactants. Such electrolytes, when used herein in combination with a water-alcohol solvent at a weight percent of the total composition of from about 0.5% to 5% of said electrolyte salt, eliminate gelation of the anionic surfactant without the need for excessively high alcohol levels.

Operable electrolyte salts include the alkali metal chlorides, sulfates and carbonates, and the salts formed from the reaction of alkanolamines with inorganic acids, e.g. HCl, $H_2SO_4$, and organic acids such as formic, acetic, propionic, butyric and citric acid. Specific examples of such salts include sodium chloride, potassium chloride, sodium carbonate, potassium carbonate, potassium sulfate, sodium sulfate, triethanolamine sulfate, triethanolamine citrate, triethanolamine acetate, triethanolamine formate, monoethanolamine propionate and diethanolamine butyrate. Of all the possible electrolyte salts useful to prevent gelation of the compositions herein, potassium chloride is by far the most effective and preferred. Potassium chloride is preferably added to the instant compositions to the extent of from about 1% to about 3% by weight to provide its anti-gelling effects. Potassium chloride concentrations of about 1.5% to about 1.9% are preferred for use in combination with water-alcohol carrier liquids of the type disclosed above to avoid crystallization of chloride salts after prolonged aging and chilling of the liquid compositions herein.

As noted, the use of a solvent and electrolyte serves to control and regulate gel formation in the instant liquid detergent compositions. If, however, gel formation is desired, it is possible to select particular concentrations of a water solvent which yield gelled compositions in the absence of alcohol and electrolyte salt. Thus, compositions containing the detersive components and fatty acid corrosion inhibitor in the above-specified concentrations and a water solvent comprising the balance, i.e., about 5% to 20% by weight, will be thick or gelled compositions, provided no alcohol or electrolyte is present.

Other optional, non-essential, non-interfering components are preferably added to the instant compositions to provide improved performance or aesthetic appeal. One such preferred type of composition is that containing a color stabilizing agent, especially citric acid. Such compositions exhibit surprising stability against the tendency to redden on prolonged storage. In addition, the presence of citric acid in the compositions of this invention has a beneficial effect from the standpoint of preventing the development of unsightly colored stains observed on the outer surfaces of plastic bottles occasioned by spillage, seepage of handling of bottles with hands previously in contact with the instant compositions. As with the anionic surfactant acids, the citric acid color stabilizer forms alkanolamine citrate when added to the instant compositions containing excess alkanolamine. In the preferred embodiment wherein the alkali metal base is added, an alkali metal citrate is formed as well. For convenience, however, this alkanolamine and/or alkali metal citrate in concentration in the compositions is expressed as a weight percentage of the free acid form of the citrate, i.e., citric acid, added to the compositions. An amount of citric acid of up to about 1% by weight of composition is generally added to obtain these color benefits. To achieve these benefits, the amount of citric acid used is preferably in the range from about 0.05% to about 0.15% by weight of the composition. Of course, the compositions must still be formulated to maintain the minimum of about 1% (wt.) of free alkanolamine.

Suds modifying agents can be present in the instant compositions in minor proportions to provide high foaming or low foaming products, as desired. While the compositions herein inherently provide adequate suds levels, some users desire copious lather from laundry detergent products. Accordingly, the compositions herein can optionally contain up to about 10% by weight of suds boosters. However, for most purposes, such suds boosters are not employed since the compositions herein provide optimal suds levels for the average user.

Other optional components include brighteners, fluorescers, enzymes, bleaching agents, anti-microbial agents, and coloring agents. Such components preferably comprise no more than about 3% by weight of the total composition.

Utilization of the specific surfactants at the specific nonionic surfactant to anionic surfactant (free acid basis) ratios in the recited range, in combination with excess free alkanolamine, is critical to the formulation of detergent compositions having the unexpected performance and stability characteristics of the instant invention. Formation of mixed surfactant micelles, which results from the use of the hereindisclosed nonionic-anionic surfactant ratios, provides unexpected detergency performance which is insensitive to water hardness.

The use of alkanolamine salts and excess alkanolamine also contributes to the effectiveness of the instant compositions. For example, these compositions containing the alkanolamine counterion in combination with excess free alkanolamine are superior for cleaning polyester/cotton than corresponding compositions containing the more conventional sodium or potassium salts of the anionic surfactant acids and no free alkanolamine. Of the alkanolamines, triethanolamine is preferred herein from the standpoint of availability and cleaning efficiency.

The compositions of the instant invention are specifically designed to provide optimum cleaning benefits when used in either of the two modes commonly employed with liquid detergent compositions. First, the compositions herein can be used as pre-treatment agents which are applied in concentrated form directly onto fabric stains prior to fabric washing. Second, the instant compositions are also useful as detergents for conventional through-the-wash fabric laundering operations. Excellent stain removal and soil removal are attained when the instant compositions are dissolved in an aqueous washing solution at a concentration of about 0.10% by weight (approximately ¼ cup per 17–19 gallons of wash water). For through-the-wash fabric laundering, usage concentrations in the range of from 0.08% to about 0.20% by weight of the laundering liquor are preferred. Of course, usage can be adjusted, depending on the soil load and the desires of the user.

With regard to pre-treatment efficacy, the compositions containing the herein specified components and component ratios provide oily stain removal from polyester or polyester/cotton fabrics which is superior to similar pre-treatment performance attained with conventional built anionic detergent compositions. In fact, pre-treatment efficacy is comparable with regard to oily stain removal with that attained with pure nonionic surfactants which are known to be particularly useful in such pre-treatment processes. On the other hand the compositions of the instant invention are far superior to conventional nonionic surfactant-based products for through-the-wash soil removal (especially from cotton) under standard home laundering conditions. Through-the-wash detergency performance of the instant compositions is comparable with that attained with conventional built granular detergent compositions.

The compositions of this invention provide their superior detergency benefits without harming metal surfaces in washing machines.

The following examples illustrate the detergent compositions of the instant invention. The abbreviations for the nonionic surfactants employed, e.g., $C_{14}(EO)_6$, are standard for such materials and describe the average carbon content of the alcoholic lipophilic portion of the molecule and the ethylene oxide content of the hydrophilic portion of the molecule.

EXAMPLE 1

A storage-stable, non-gelling, liquid detergent composition is as follows.

| Component | Wt. % |
|---|---|
| *$C_{14-15}(EO)_7$ | 32.4 |
| Linear alkylbenzene sulfonic acid wherein the alkyl chain averages 11.4 carbon atoms in length (free acid form) | 16.2 |
| Triethanolamine (total) | 11.0 |
| Oleic acid (free acid form) | 0.5 |
| Ethanol | 2.8 |
| Potassium chloride | 1.5 |
| Citric acid (free acid form) | 0.1 |
| Brightener, perfume, dye | 1.5 |
| Water | Balance |

*Commercially available as Neodol 45-7

The weight ratio of nonionic surfactant to anionic surfactant (on a free acid basis) in the foregoing composition is 2.00.1. The above composition contains about 3.5% free triethanolamine. The composition is prepared by simply blending the ingredients in the recited ratios.

The foregoing composition is a stable (i.e., does not separate or otherwise degrade or develop color on storage and handling and is satisfactory for use after being subjected to a freeze-thaw cycle) clear liquid detergent which does not gel upon dilution with water. The composition provides level, medium-high sudsing in wash water of varying temperature and hardness. The foregoing composition provides both excellent pretreatment and through-the-wash fabric detergency.

The composition of Example I is found to passify metal surfaces, especially ferrous metals, as compared with similar compositions which do not contain the oleic acid.

In the above composition the triethanolamine is replaced by monoethanolamine and diethanolamine, respectively, and good overall detergency is secured.

EXAMPLE II

| Component | % Wt. |
|---|---|
| Condensation product of average 7 moles of ethylene oxide with $C_{14-15}$ synthetic alcohol | 33.0 |
| Linear alkylbenzene sulfonic acid wherein the alkyl chain averages 11.4 carbons in length (free acid form) | 11.0 |
| Triethanolamine (total) | 11.0 |
| Ethanol | 3.0 |
| Citric acid (free acid form) | 0.7 |
| Potassium chloride | 1.7 |
| Oleic acid (triethanolamine form) | 0.7 |
| Minors (Brighteners, perfume, coloring agents) | 0.9 |
| Water | Balance |

The above composition composition contains about 5.5% free triethanolamine. The foregoing composition is stable and provides excellent fabric cleaning when used either full strength as a pre-treatment or for through-the-wash detergency at a level of ¼ cup/17 gallons of wash water. The composition passifies iron and steel surfaces.

The composition of Example II is modified by replacing the oleic acid with tallow- and coconut-fatty acid mixtures, respectively, and a passification benefit is secured concurrently with good detergency performance.

The composition of Example II is modified by replacing the nonionic hepta-ethoxylate with an equivalent amount of n-$C_{13}(EO)_3$, n-$C_{15}(EO)_7$, n-$C_{16}(EO)_9$, 2-$C_{14}(EO)_6$, and 2-$C_{16}(EO)_9$, respectively, and good pre-treatment and through-the-wash detergency on cotton and cotton/polyester blend fabrics is secured.

EXAMPLE III

| Component | % Wt. |
|---|---|
| Condensation product of average 9 moles of ethylene oxide with $C_{14-15}$ synthetic alcohol | 45.0 |
| Linear alkylbenzene sulfonic acid wherein the alkyl chain averages 12 carbons in length (free acid form) | 22.0 |
| Triethanolamine (total) | 20.0 |
| Ethanol | 3.0 |
| Oleic acid (free acid form) | 2.0 |
| Minors (Brighteners, color stabilizers, perfume, coloring agents) | 0.9 |
| Water | Balance |

The above composition contains about 9% free triethanolamine. The foregoing composition is a paste which provides excellent fabric cleaning when used either full strength as a pre-treatment or for through-the-wash detergency at a level of ⅛ cup/17 gallons of wash water. The product is non-corrosive to metal.

EXAMPLE IV

| Component | Wt. % |
|---|---|
| $C_{14-15}(EO)_7$ | 32.0 |
| Linear alkylbenzene sulfonic acid wherein the alkyl chain averages 11.4 carbon atoms in length (free acid form) | 16.2 |
| Triethanolamine (total) | 11.0 |
| Oleic acid (free acid form) | 1.0 |
| Potassium hydroxide | 1.3 |

EXAMPLE IV-continued

| Component | Wt. % |
|---|---|
| Ethanol | 4.7 |
| Citric acid (free acid form) | 0.1 |
| Miscellaneous (brightener, perfume and dye) | 1.1 |
| Water | Balance |

The weight ratio of nonionic surfactant to anionic surfactant (on a free acid basis) is 1.98:1. The composition contains about 2.7% free triethanolamine. The liquid composition is prepared by blending together the individual components. The composition has a pH of 8.5.

Satisfactory pre-treatment and through-the-wash fabric detergency is provided by this composition. Moreover, the composition is stable and provides a corrosion inhibition effect to the steel surface of a wash machine wherein the composition was used. The corrosion inhibition provided by this composition is greater than that provided by a similar composition containing no potassium hydroxide and substantially greater than that provided by a similar composition containing no potassium hydroxide and oleic acid.

Substantially the same results are obtained when mono- and diethanolamine replaces the triethanolamine and sodium hydroxide replaces the potassium hydroxide.

As can be seen from the foregoing, the present invention encompasses advantageous liquid detergent compositions specifically designed to achieve a variety of benefits heretofore unavailable to the user of such products. First, the compositions are formulated to provide optimal through-the-wash and pre-treatment cleansing of fabrics. This is accomplished by formulating an active detergent mixture comprising a narrowly selected group of nonionic surfactants, an alkanolamine neutralized alkylbenzene sulfonate (mixture of alkanolamine and alkali metal neutralized alkylbenzene sulfonate in the preferred embodiment) and a free alkanolamine, and combining these ingredients in specific proportions to achieve the desired result. Secondly, the compositions herein are formulated to provide the long-term stability so necessary to any commercial product which is subjected to the rigors of shipping, storage and handling under a variety of conditions. The stability of the compositions herein is achieved both by virtue of the proper selection of detersive ingredients and their use in critical proportions, and by the inclusion of additives such as citric acid and potassium chloride, which maintain color stability and prevent undesired thickening of the product. Indeed, even the water-alcohol carrier liquid employed in the compositions is formulated at critical ratios to help provide long-term stability without the undesirable precipitation of solids on storage. Finally, the compositions herein are formulated to provide a beneficial passification effect on metal surfaces, thereby prolonging the life of washing machines, with obvious advantages to the user. This feature of the present compositions has been achieved without recourse to the common, phosphorus-based, corrosion inhibitors. Surprisingly, this desirable aspect of the invention has been achieved by employing a very minor proportion of a fatty acid, such as oleic acid, in the compositions.

The foregoing benefits are achieved by formulating detergent compositions using the various ingredients and ingredient ratios fully disclosed hereinbefore, and such compositions provide excellent all-around fabric cleaning performance under conditions employed by the average home user, coupled with excellent product stability and aesthetics.

What is claimed is:

1. A liquid detergent composition consisting essentially of:

(a) from about 20% to about 50% by weight of a nonionic surfactant produced by the condensation of from about 5 moles to about 11 moles of ethylene oxide with one mole of a $C_{13}$ to $C_{16}$ alcohol, said nonionic surfactant being characterized by an HLB of from about 9.5 to about 15, or mixtures thereof;

(b) an anionic surfactant which is a mixture of an alkanolamine and an alkali metal salt of an alkylbenzene sulfonic acid where the alkyl group contains from about 9 to about 15 carbon atoms and wherein said alkanolamine is selected from the group consisting of mono-, di-, and triethanolamines and said alkali metal is selected from the group consisting of sodium and potassium, at a weight ratio of nonionic surfactant to anionic surfactant of from about 1.8:1 to about 3.5:1 based on the free acid form of the anionic surfactant;

(c) at least 1% by weight of free alkanolamine selected from the group consisting of mono-, di-, and triethanolamine;

(d) from about 0.15% to about 2% by weight of a $C_{10}$–$C_{22}$ fatty acid, or mixtures thereof;

(e) from about 0.1% to about 4.0% by weight of an alkali metal base selected from the group consisting of sodium and potassium hydroxides; and (f) the balance being water or a water-alcohol carrier liquid wherein said alcohol is a monohydric alcohol containing from 1 to to about 5 carbon atoms.

2. A composition according to claim 1 wherein the nonionic surfactant is the condensate of from about 6 to 9 moles of ethylene oxide with a $C_{14-15}$ alcohol and has an HLB within the range of 11 to 13.

3. A composition according to claim 1 wherein the alkali metal base is potassium hydroxide 4. A composition according to claim 1 consisting essentially of:

(a) from about 31% to about 34% by weight of a nonionic surfactant which is the condensation product of an average of about 7 moles of ethylene oxide with one mole of a $C_{14-15}$ (avg.) alcohol;

(b) from about 15% to about 17.5% by weight (free acid form) of an anionic surfactant which is a mixture of the triethanolamine and potassium salts of a $C_{11.4}$ (avg.) alkylbenzene sulfonic acid;

(c) at least 1% by weight of free triethanolamine;

(d) from about 0.3% to about 1.2% by weight of oleic acid;

(e) from about 1.0% to about 2.5% by weight of an alkali metal base selected from a group consisting of sodium and potassium hydroxides;

(f) from about 0.5% to about 0.15% by weight of citric acid, based on the free acid form;

(g) from about 2.0% to about 5.5% by weight of ethanol; and (h) from about 25% to about 40% by weight of water.

5. A composition according to claim 1 which additionally contains from about 0.5% to about 5% by weight of a water-soluble electrolyte capable of preventing gelation.

6. A composition according to claim 1 wherein the alkanolamine salt of the anionic surfactant is the triethanolamine salt.

7. A composition according to claim 6 wherein the nonionic:anionic surfactant weight ratio (free acid form) is in the range of from about 1.9:1 to about 3.0:1.

8. A composition according to claim 7 wherein the free alkanolamine is present in the composition at a concentration of from about 2.0% to about 10.0% by weight.

9. A composition according to claim 8 wherein the free alkanolamine is triethanolamine.

10. A composition according to claim 9 wherein the fatty acid is oleic acid.

11. A composition according to claim 10 wherein the carrier liquid comprises a mixture of water and ethanol at a weight ratio of water:ethanol in the range of from about 5:1 to about 20:1.

12. A composition according to claim 11 which additionally contains up to about 1% by weight of citric acid, based on the free acid form.

* * * * *